United States Patent [19]

Mazur

[11] 4,376,424

[45] Mar. 15, 1983

[54] CENTRIFUGAL FAN CONTROL

[75] Inventor: Joseph S. Mazur, Livonia, Mich.

[73] Assignee: Eaton Corporation, Cleveland, Ohio

[21] Appl. No.: 183,508

[22] Filed: Sep. 2, 1980

[51] Int. Cl.[3] ..... F01P 3/18

[52] U.S. Cl. ..... 123/41.12; 123/41.49

[58] Field of Search ..... 123/41.11, 41.12, 41.48, 123/41.49, 41.65, 41.66, 198 C

[56] References Cited

U.S. PATENT DOCUMENTS

| | | | |
|---|---|---|---|
| 2,204,926 | 6/1940 | Clingerman | 180/54 |
| 2,214,933 | 9/1940 | Nelson | 123/41.49 X |
| 2,511,549 | 6/1950 | Simi | 123/41.49 X |
| 2,680,490 | 6/1954 | DaFoe | 180/54 |
| 3,358,655 | 12/1967 | Camps | 123/41.49 X |
| 3,494,453 | 2/1970 | Sepko | 192/84 R |
| 3,613,645 | 10/1971 | Froumajou et al. | 123/41.46 |
| 3,630,003 | 12/1971 | Ashton et al. | 123/41.49 X |
| 3,696,730 | 10/1972 | Masuda et al. | 98/206 |
| 3,856,100 | 12/1974 | Manning | 180/54 A |
| 3,872,842 | 3/1975 | Medley | 123/41.11 X |
| 3,915,024 | 10/1975 | Mort | 123/41.49 X |
| 3,918,547 | 11/1975 | Kramer et al. | 180/54 A |
| 4,007,999 | 2/1977 | Serizawa | 416/178 |
| 4,051,936 | 10/1977 | Crisenbery et al. | 192/82 T X |
| 4,175,388 | 11/1979 | Milbreath et al. | 60/337 |

FOREIGN PATENT DOCUMENTS 1203541 10/1965 Fed. Rep. of Germany .

OTHER PUBLICATIONS

*Fans;* Dr. Ing. Bruno Eck; 1973, Chapter X, Vieweg & Sohn GmbH, Burgplatel, Braunschweig.

*Primary Examiner*—William A. Cuchlinski, Jr.
*Attorney, Agent, or Firm*—C. H. Grace; P. S. Rulon

[57] ABSTRACT

Disclosed is a vehicle having an engine (20) transversely mounted for rocking motion relative to the vehicle frame (42); an engine cooling radiator (22) mounted forwardly of the engine and substantially parallel to the rotational axis of the engine crankshaft; a cross-flow fan (24) having a rotational axis fixed against movement relative to the vehicle frame, substantially parallel to the crankshaft axis, and between the crankshaft axis and the plane of the radiator; a belt drive (32, 34, 36) for rotating the fan in response to rotation of the crankshaft; means (100 or 120) for maintaining the belt tension relatively constant when the engine rocks; and means (29 or 121) to vary the fan speed relative to the crankshaft speed in response to the cooling requirements of the engine. In one embodiment the tensioning means is incorporated in split pulley (36) of the belt drive, in the other embodiment the tensioning means is a spring load idler pulley (120). In one embodiment the means to vary the fan speed in response to cooling requirements is a viscous coupling, in the other embodiment it is an electromagnetic clutch.

11 Claims, 7 Drawing Figures

FIG. 1.
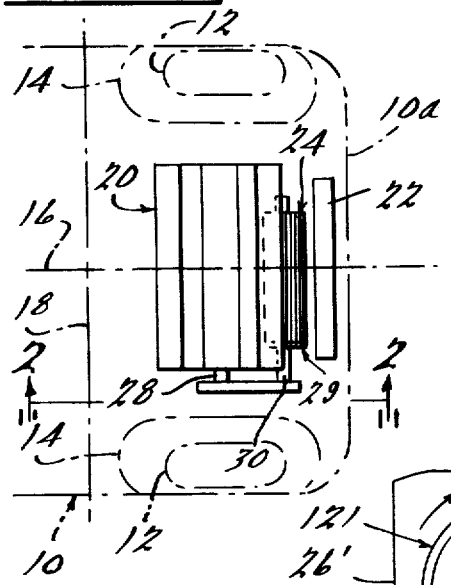
FIG. 2.
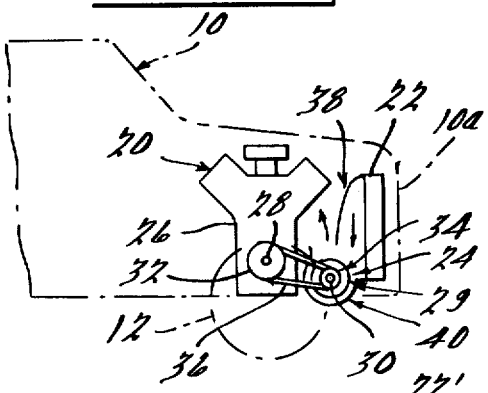
FIG. 7.
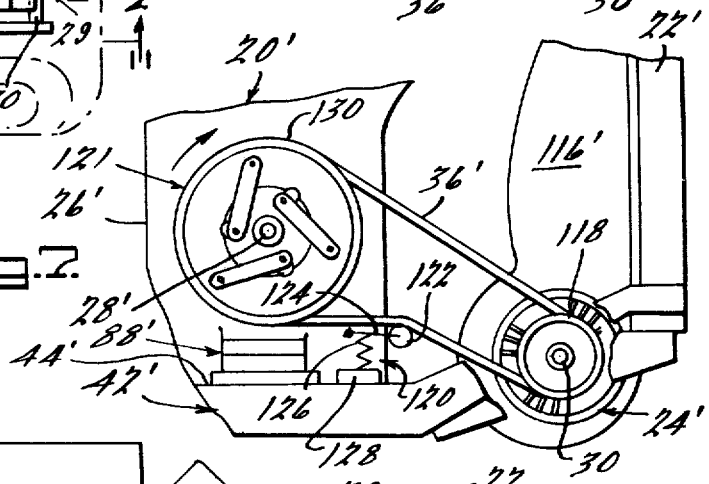
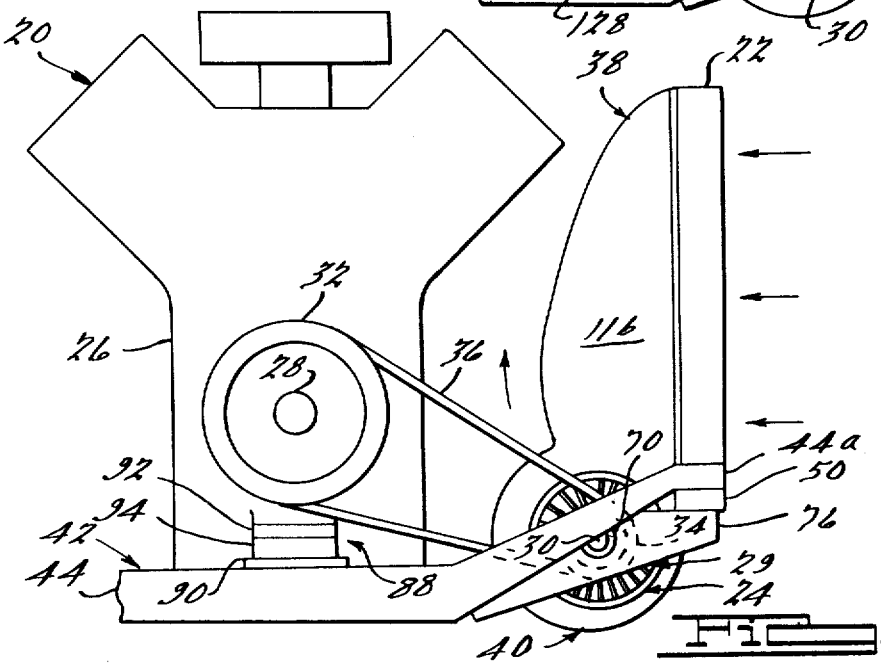
FIG. 3.

CENTRIFUGAL FAN CONTROL

CROSS-REFERENCE TO RELATED APPLICATIONS

This application is related to U.S. pat. application Ser. Nos. 172,882, filed July 28, 1980 and 183,890, filed Sept. 4, 1980. Both of these applications are assigned to the assignee of this application.

FIELD OF THE INVENTION

This invention relates to vehicle engine cooling and, in particular, to a mechanically driven centrifugal fan with means to vary the fan speed in response to engine cooling needs.

BACKGROUND OF THE INVENTION

The current proliferation of front wheel drive vehicles with liquid-cooled engines mounted transverse to the longitudinal axis of the vehicle has complicated traditional cooling fan drive arrangements wherein the engine is mounted parallel to the longitudinal axis. Vehicles with either longitudinally or transversely mounted engines preferably have the radiator positioned forwardly of the engine and in a plane transverse to the longitudinal axis since such positioning provides direct access for ambient air flow through the radiator, particularly ram air, and since space for the radiator is readily provided with such positioning.

In vehicles with longitudinally mounted engines, forwardly mounted radiators, and axial flow fans mounted therebetween, the axial flow fans are conveniently mounted on the front of the engines with the rotational axes of the fans positioned parallel to the engine crankshaft axes and the fans are readily driven by mechanical drives such as belts driven by pulleys mounted on forward projections of the engine crankshafts. Such driven arrangements are simple, reliable, relatively inexpensive, and last, but not least, relatively efficient. In vehicles with radiators mounted forward of the engines and parallel to the rotational axes of the engine crankshafts (as is the case with transverse engine vehicles), axial flow fans cannot be readily mounted on the engines with the rotational axes of the fans parallel to the crankshaft axes and cannot be readily driven by mechanical drive arrangements such as belts driven by pulleys mounted on projections of the engine crankshafts, since the necessary space for such arrangements is not available. Hence, vehicles with transversely mounted engines and radiators mounted forward of the engines and parallel to the axes of the engine crankshafts, for the most part, now use electric motors to drive the fans. The electric motors are, in general more expensive than mechanical drive arrangements and are believed to be less reliable. Further, since the electric motors are price sensitive per unit horsepower and are substantially less efficient than mechanical drives, some vehicle manufacturers have increased the size of the radiators to reduce motor size and have spent considerable time developing more efficient fans to further reduce motor size.

One prior art reference, U.S. Pat. No. 3,696,730 issued Oct. 10, 1972, schematically discloses a transverse engine vehicle with a forwardly mounted radiator and several embodiments of mechanically driven fans. One embodiment discloses a centrifugal fan with axial inlet and radial outlet mounted on one end of the engine. The other embodiments disclose axial flow fans transversely disposed with respect to one end of the engine and with the rotational axes of the fans either in line with the engine crankshaft axis or forward thereof. All of these embodiments require transverse offsetting of the radiators and/or the engines, transverse offsetting of the fans, bulky ducts for directing air to and from the fans, and tortuous flow paths for the air. Transverse offsetting of the radiators though possible even in relatively small cars is not desirable since it interferes with headlight and fender mounting unless the front of the vehicle is extended to provide additional room. Transverse offsetting of transversely mounted engines is undesirable since it upsets vehicle weight distribution and as a practical matter, there is insufficient transverse space for such offsetting in passenger vehicles with forwardly mounted transverse engines. Likewise, there is insufficient transverse space for transverse offsetting or positioning of the fans at one end of the engines. Further, the bulky or large ducts for directing the air to and from the fans would at best be difficult to install in the limited space available in such vehicles.

In addition, the cooling fan embodiments of the above mentioned patent do not provide means to vary the fan speed in accordance with engine cooling needs. In a present day vehicle with air-conditioning, a cooling fan having the pumping capacity to cool both the engine radiator and the air conditioner condenser has far more pumping capacity than is needed when the air conditioner is not in use or when the forward speed of the vehicle is great enough to provide cooling by ram air. Such excess fan capacity puts a substantial horsepower drain on already small engines and wastes energy.

SUMMARY OF THE INVENTION

An object of this invention is to provide a cooling fan which is compact and efficiently driven by a vehicle engine.

Another object of this invention is to provide such a cooling fan and drive for a vehicle having a forwardly mounted transverse engine.

According to a feature of the invention, a vehicle including a liquid-cooled engine, a centrifugal cooling fan for directing air through a radiator, a mechanical drive for rotating the fan in response to rotation of the engine crankshaft, means for sensing the cooling requirements of the engine, and means drivingly interposed between the crankshaft and the fan for varying the rotational speed of the fan with respect to the crankshaft speed in response to sensed cooling requirements of the engine.

According to another feature of the invention, a vehicle includes a liquid-cooled engine having a crankshaft mounted therein for rotation about an axis, a centrifugal cooling fan mounted for rotation about an axis laterally spaced from and substantially parallel to the crankshaft axis, a belt drive for rotating the fan in response to rotation of the crankshaft, and means interposed between the crankshaft and the fan for varying the rotational speed of the fan relative to the crankshaft speed in response to the cooling requirements of the engine. According to another feature of the invention a vehicle includes a liquid-cooled, forwardly mounted engine having a crankshaft mounted therein for rotation about an axis transverse to the longitudinal axis of the vehicle, a radiator mounted forwardly of the engine and having a width generally parallel to the crankshaft axis with the discharge side of the radiator facing the engine, a cross-flow fan mounted for rotation about an axis substantially parallel to the crankshaft axis and positioned to receive discharge air from the radiator, a belt drive for rotating the fan in response to rotation of the crankshaft, and a viscous coupling interposed between the crankshaft and fan for varying the rotational speed of the fan relative to the crankshaft speed in response to the cooling requirements of the engine.

BRIEF DESCRIPTION OF THE DRAWINGS

A cross-flow cooling fan, a mechanical belt drive arrangement with tensioning means, and means to control the rotational speed of the fan are shown in the accompanying drawings in which:

FIG. 1 is a downwardly looking schematic of the invention disposed in a partial outline of a vehicle;

FIG. 2 is a vertical schematic of the invention looking along line 2—2 of FIG. 1;

FIG. 3 is an enlargement of a portion of FIG. 2, still in schematic form but with substantially more detail;

FIG. 7 is a modified schematic of the invention shown in the other figures.

Figure 4:
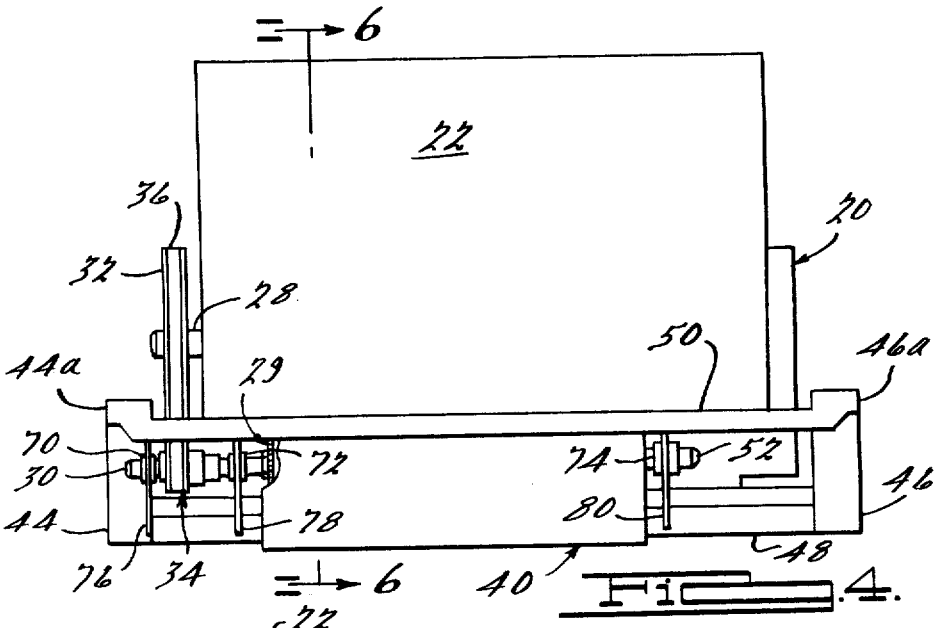
FIG. 4 is a vertical schematic of the invention looking along line 4—4 of FIG. 3.

Certain terminology referring to specific types of components, direction, motion, and the relationship of components to each other will be used in the following description. This terminology is for convenience in describing the invention and should not be considered limiting unless explicitly used in the claims.

DETAILED DESCRIPTION OF THE DRAWINGS

FIG. 1 is a plan view of a front portion of a vehicle with the vehicle body 10, front wheels 12, and inner fenders 14 shown in phantom lines. The vehicle grille or front 10*a* faces the direction of forward vehicle motion. Axis line 16 represents a longitudinal axis of the vehicle and axis line 18 represents a transverse axis of the vehicle. Within body 10 is a transversely mounted engine 20 of the liquid-cooled type, a radiator 22 mounted behind the grille and forward of the engine with the grille width substantially parallel to the transverse axis, and a cross-flow fan 24 mounted on the discharge or rear side of the radiator. The block outline representing radiator 22 may also include an air-conditioning condenser. Cross-flow fans, which are sometimes referred to as double traverse fans or tangential fans are species of centrifugal fans but differ from commonly known centrifugal fans in that they pump air radially inward and outward such that the air passes chordally across the circumferential extent of the fan, whereas commonly known centrifugal fans pump air radially inward and then axially outward or vice versa. For a given fan speed and pumping capacity cross-flow fans are generally smaller in diameter than commonly known centrifugal fans, whereby the cross-flow fans are more readily positioned in limited spaces. Further, since cross-flow fans pump air chordally across the circumferential extent of the fans, the fans and their inlet and outlet ducts may be positioned directly behind the radiators, whereby the packaging of cross-flow fans and their ducts may be made substantially more compact than the packaging of the commonly known centrifugal fans and their ducts.

Looking now at both FIGS. 1 and 2, engine 20, which may drive the front wheels and/or the rear wheels, includes a housing or block 26 having an unshown crankshaft mounted therein for rotation about an axis substantially parallel to the transverse axis. A shaft 28, which projects from block 26, may be an extension of the crankshaft or a shaft driven by the crankshaft. The cross-flow fan 24 is connected at its input with a viscous coupling 29 having an input shaft 30 which is driven by a mechanical drive assembly including a V-pulley 32 fixed to shaft 28, a split V-pulley 34 fixed to rotate with input shaft 30, and a V-belt 36. In FIG. 2, cross-flow fan 24 is shrouded by an inlet duct 38 and an outlet duct 40. Ducts 38 and 40 are not shown in FIG. 1 so that the position of the cross-flow fan with respect to the radiator and engine may be readily seen.

Figure 5:
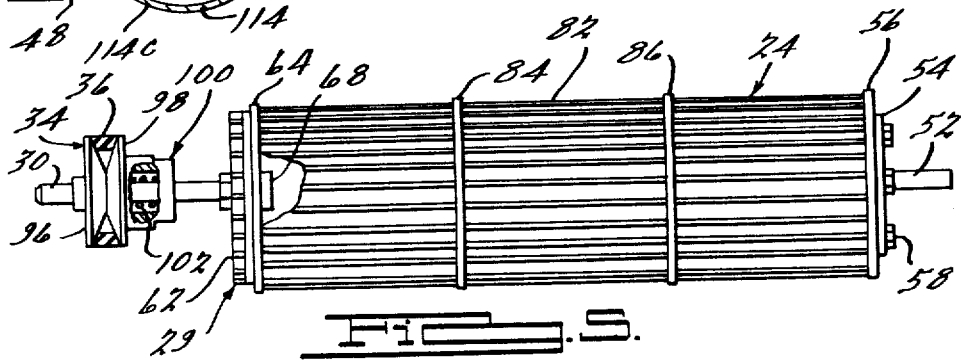
FIG. 5 is an enlarged view of a cross-flow fan with a split pulley and a viscous coupling positioned on the input to the fan.

Looking now at FIGS. 3–5, which are more detailed schematics of the embodiment of FIGS. 1 and 2 and starting with FIGS. 3 and 4, engine 20 and radiator 22 are conventionally mounted on a vehicle frame 42. Frame 42 includes two horizontally, longitudinally extending rails 44 and 46 and a transverse cross member 48. Forward of the engine, rails 44 and 46 taper down and are bent upward at about a 30° angle. The forward ends 44*a* and 46*a* of the rails provide support for a transverse cross member 50 which supports the radiator. Cross member 50 may be formed integrally with the radiator. The radiator may be shock or vibration insulated from frame 42 by conventional rubber mounts which are not shown. But for all practical purposes, the mounts fix the radiator against movement relative to the frame.

As may be seen in FIGS. 4 and 5, the rotational axis of cross-flow fan 24 is defined by input shaft 30 at the left end of the fan and a shaft 52 at the right end of the fan. Shaft 52 is fixed to an end plate 54 which is secured to an end ring 56 of the fan by a plurality of bolts 58. At the left end of the fan, viscous coupling 29 is interposed between the fan and the input shaft. Coupling 29, which may be substantially the same as the coupling disclosed in U.S. Pat. No. 4,051,936, includes a housing 62 secured to an end ring 64 of the fan by a plurality of unshown bolts, an unshown fluid working chamber defined by the housing and containing a viscous fluid, and an unshown drive or input member rotatably disposed in the working chamber and driven by input shaft 30. U.S. Pat. No. 4,051,936, issued Oct. 4, 1977, is incorporated herein by reference. However, many other types of viscous coupling may be used, e.g., the coupling disclosed in U.S. Pat. No. 4,056,178 issued Nov. 1, 1977 or U.S. Pat. No. 3,972,399, issued Aug. 3, 1976. Housing 62 is rotated by viscous shear forces in response to rotation of input shaft 30. The shear forces determine the torque transmitting capacity of the coupling and therefore the rotational speed differences between input shaft 30 and housing 62. To control the torque transmitting capacity, coupling 29 includes an unshown pump in the working chamber for pumping the viscous fluid out of the chamber to a reservoir, an unshown valve which controls fluid to and from the reservoir, and a bimetalic spring 68 mounted on an outer portion of housing 62 which faces the interior of fan 24. Spring 68 responds to the temperature of the air flowing across the interior of the fan. When the air temperature is above a predetermined amount and a maximum torque capacity is needed, spring 68 moves the unshown valve to a position restricting fluid flow from the working chamber to the reservoir and allowing fluid flow from the reservoir to the working chamber. When the air temperature is below a predetermined amount and a minimum torque capacity is needed, spring 68 moves the unshown valve to a position allowing fluid flow from the working chamber to the reservoir and restricting fluid flow from the reservoir to the working chamber. For intermediate air temperatures, spring 68 modulates the valve position to control the torque of the coupling at required amounts between the maximum and minimum.

Shafts 30 and 52 are journaled in bearings 70, 72, and 74, carried by support members 76, 78, and 80. Member 76 is fixed to cross member 50 and rail 44, and members 78 and 80 are fixed to cross members 48 and 50. Collectively, the members fix the rotational axis of the fan relative to the frame with the fan axis substantially parallel to the rotational axis of the engine crankshaft and behind the plane of the radiator. The double bearing support of shaft 30 is to prevent skewing of the shaft due to side loads caused by V-belt 36.

The outer circumferential extend of the fan is defined by a plurality of forwardly leaning blades 82 (herein twenty-four blades) which are circumferentially arrayed about the rotational axis of the fan. The forward leaning of blades 82 is most clearly shown in FIG. 6. The blades are supported at their ends by the end rings 56 and 64 and are supported therebetween by intermediate rings 84 and 86 with the axial extent of the blades parallel to the rotational axis and with the radial extend of the blades extending generally inward toward the rotational axis. The axial extend of blades 82 preferably, but not necessarily, extend the full or (as herein) substantially the full width of the radiator, thereby providing a direct and low resistance air flow path from the radiator to the fan. As may be seen in FIG. 4, fan 24 is positioned somewhat offset with respect to the vertical center of the radiator. This offset positioning was done to minimize the length of input shaft 30 of the test fan. The test was conducted in a front wheel drive vehicle having a transversely mounted V-6 engine and a radiator about twenty-four inches wide. The test fan was about eighteen inches long and about six inches in diameter. Fan 24 may extend the full width of the radiator, may extend less than the full width and be centered, or comprise a plurality of such fans. When a plurality of fans are used, they may be axially aligned and/or vertically stacked with respect to each other. A single fan of the same capacity as fan 24 may be made be increasing the fan length and reducing the fan diameter.

Looking again at FIG. 3, engine 20 is conventionally mounted on frame 42 via mounts which allow the engine to rock or move transverse to the crankshaft axis in response to varying engine load, such rocking or transverse movement being reaction torque on the crankshaft. Only one engine mount 88 is shown. The mount includes metal plates 90 and 92 fixed respectively to rail 44 and block 26 and a rubber pad 94 bonded to the plates. Engine 20 rocks counterclockwise with respect to mount 88 in response to increasing load, thereby increasing the center distance between shafts 28 and 30 with increasing engine load.

Looking now at FIGS. 4 and 5, and in particular at FIG. 5, split pulley 34 includes pulley halves 96 and 98 and a tensioning means 100. Pulley half 96 is fixed against rotation and axial movement relative to shaft 30. Pulley half 98 is fixed against rotation relative to shaft 30 but is free to slide axially. Tensioning means 100 includes a helical spring 102 partially shown in a broken-away portion of a protective cover. Spring 102 biases pulley half 98 toward half 96, thereby resiliently reducing the width of the V-groove defined by the two halves. When the width of the V-groove is a minimum, pulley 34 presents a maximum diameter to V-belt 36. When engine 20 rocks counterclockwise and changes the center distance between shafts 28 and 30, the tension on V-belt 36 tends to increase. Hence, pulley half 98 moves axially against spring 102 to widen the V-groove and allows the V-belt to move deeper into the groove, whereby pulley 34 presents a reduced diameter to the V-belt to maintain a relatively constant tension on the V-belt. The change in the diameter presented to the V-belt by pulley 34 also changes the speed ratio between shaft 28 and 30. Hence, in the disclosed embodiment with pulley 34 mounted on input shaft 30 the rotational speed of fan 24 will increase with increasing engine load. By mounting pulley 34 on shaft 28 the fan speed will decrease with engine load.

Figure 6:
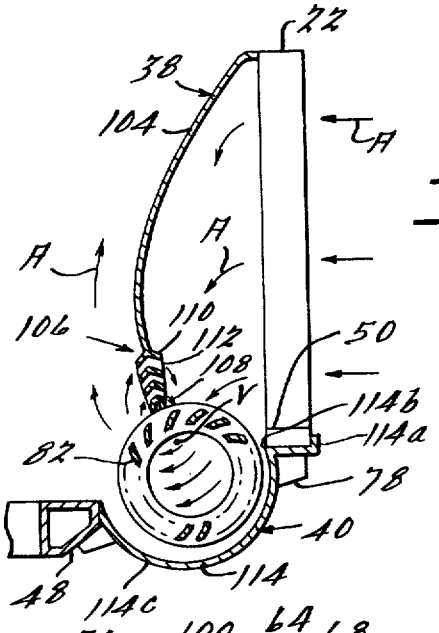
FIG. 6 is a sectioned portion of the invention looking along line 6—6 of FIG. 4.

Looking now mainly at FIG. 6, the inlet and outlet ducts 38 and 40 may be formed of sheet metal or plastic materials. The inlet duct 38 includes a sheet metal member 104 fixed at its upper end to the radiator and extending downward and generally rearward to about the eleven o'clock position of the fan wherein it defines or is integrally formed with a cascade or louver assembly 106. The assembly includes a rod or tubular member 108 closely spaced outward of the outer circumferential extent of the fan blades and extending substantially the full axial extent of the blades, a plurality of V-shaped louvers 110 equal in length to member 108, and a plurality of vertically extending spacers or strut pieces 112 between the tubular member and the louvers. Outlet duct 40 includes a sheet metal member 114 extending the full axial length of the fan blades and having a portion **114*a* fixed to cross member 50, a portion 114*b* closely spaced radially outward of the fan blades at about the three o'clock position of the fan, and an involute portion 114*c* extending from portion 114*b* to about the eight o'clock position of the fan where it is fixed to cross member 48. Ducts 38 and 40 are closed at their left and right ends by side members common to both ducts. One side member 116 is shown in FIG. 3. In the other figures, side member 116 is removed so that the cross-flow fan may be readily seen. Tubular member 108 and portion 114*b*** define the circumferential boundaries separating the fan inlet area from the outlet area.

Looking now at the air flow through fan 24, a recirculation or back flow of air already transmitted to the inside of the fan or impeller is caused by an unavoidable internal vortex within the fan. The vortex is generally centered at a radial point traversed by the inner edges of the fan blades. The recirculating air or vortex size is responible for energy losses which can be considerable. Fan efficiency, which is proportional to the total volume of the recirculating air, can be controlled by controlling the size of the vortex. The vortex within fan 24 is generally centered at about a point V and is controlled by cascade assembly 106. Several other means for controlling the vortex are known and can be found in Fans, Dr. -Ing. Bruno Eck, 1973 Vieweg & Sohn GmbH, Burgplatz 1, Braunschweig, which is incorporated herein by reference. Looking now at the air flow arrows A in FIG. 6, in general, the air flows in hook curved paths in vertically extending planes which are generally parallel to the longitudinally axis of the vehicle. Air passes through the core of the radiator 22 to the inlet area of the fan where it is impelled radially inward by the blades 82 and chordally across the interior of the fan where it is then impelled radially outward by the blades to the discharge area. As may be seen, the radius of curvature of the air within the fan decreases in proportion to its proximity to the vortex center V. Due to the vortex and the upsweep of involute portion 114c, as the air leaves the fan it is impelled upward and to the right in a clockwise motion. A portion of this air passes through louvers 110 of the cascade assembly and back to the inlet area. The remainder of the air, due to the circular motion, forms a thin air stream over the width of the backside of sheet metal member 104, whereby the air readily flows through the confined space between the engine and sheet metal member 104 without need for an extended outlet duct which in the test vehicle would interfere with other components on the vehicle. Instead of directing all of the discharge air upward and over the backside of sheet metal member 104, a portion of the discharge air may be directed under engine 20 by shortening involute portion 114c. For example, if all of the transverse length of involute portion 114c is terminated or cut away short of cross member 48, most of the discharge air will flow under the engine; if a portion or portions of the transverse length is cut away, only the air in the cut-away portion or portions will flow under the engine.

In the alternative embodiment of FIG. 7, components which are substantially the same as components in the other figures are given the same reference numbers with the addition of a prime. Accordingly, engine 20' is mounted for rocking motion relative to frame 42', the rotational axis of fan 24' is fixed against movement relative to frame 42' so that the distance between shafts 28' and 30' varies with engine load, split pulley 34 is replaced with conventional V-pulley 118, tensioning of V-belt 36' is provided by a spring loaded idler pulley assembly 120, and viscous coupling 29 is replaced with an electromagnetic clutch 121 such as disclosed in U.S. Pat. No. 3,494,453, issued Feb. 10, 1970 and incorporated herein by reference. Idler pulley assembly 120 includes a pulley or roller 122 rotatably mounted on a beam 124 pivotally mounted on the engine block or frame and a spring 126 reacting between the beam and a bracket 128 fixed to the engine or frame. Clutch 121 includes an unshown clutch half fixed to shaft 28' and a clutch half 130 mounted for rotation relative to shaft 28' and having a V-groove in its outer periphery for V-belt 36'. The clutch may be frictionally engaged by an electromagnetic force in response to the closing of an unshown temperature responsive switch. The switch may be positioned to sense the temperature of the engine cooling system and therefore cooling needs of the engine in any of several well-known ways, e.g., the switch may directly sense the radiator temperature or the discharge air temperature of the radiator.

Two embodiments of the invention have been disclosed for illustrative purposes. Many variations and modifications of the disclosed embodiments are believed to be within the spirit of the invention. To mention but a few of such variations, split pulley 34 could be mounted on shaft 28 and a conventional pulley, such as pulley 32, could be mounted on shaft 30, whereby the fan speed would decrease with increasing engine load; split pulleys could be mounted on both shafts 28 and 30, whereby the fan speed would remain substantially the same as engine load varies. Further, with respect to the embodiment of FIG. 7, the V-belt drive could be replaced by a cog belt or a serpentine belt with the tension on these belts maintained by the idler pulley assembly 120. Electromagnetic clutch 121 may be mounted between shaft 30 and fan 24 in any of the embodiments or viscous coupling 29 may be mounted on shaft 28. The following claims are intended to cover the inventive portions of the invention and variations and modifications with the spirit of the disclosed invention.

What is claimed is:

1. In a vehicle of the type including a liquid cooled, forwardly mounted engine having a crankshaft mounted therein for rotation about an axis transverse to the longitudinal axis of the vehicle; a radiator in heat exchange with ambient air, said radiator spaced forwardly of the engine with respect to the longitudinal axis and having a width generally parallel to the crankshaft axis with the discharge side of the radiator facing the engine; a fan positioned to receive air from the discharge side of the radiator and having an input shaft defining an axis about which the fan rotates; the improvement comprising:

means mounting the cooling fan for rotation about the fan axis and positioning the fan axis substantially parallel to the crankshaft axis and behind the plane of the radiator with respect to the longitudinal axis;

a cross-flow fan defining the cooling fan;

a belt drive assembly for drivingly connecting the crankshaft with the input shaft; and means drivingly interposed between the crankshaft and the fan for varying the rotational speed of the fan with respect to the rotational speed of the crankshaft in response to the cooling requirements of the engine.

2. The vehicle of claim 1, wherein said means drivingly interposed is an electromagnetically actuated clutch engaged in response to the cooling requirements of the engine.

3. The vehicle of claim 1, wherein said means drivingly interposed is a viscous coupling operative to transmit torque from the crankshaft to the fan via fluid shear forces and including means to vary the shear forces in response to the cooling requirements of the engine.

4. The vehicle of claim 3, wherein said coupling is mounted on the engine.

5. The vehicle of claim 3 wherein said coupling is mounted for rotation about the fan axis.

6. The vehicle of claim 3, wherein said coupling is interposed between said input shaft and said fan.

7. In a vehicle of the type including an engine having a crankshaft mounted therein for rotation about an axis and a fan having an input shaft defining an axis about which the fan rotates, the improvement comprising:

means mounting the engine and fan with the axes transversely spaced apart and substantially parallel to each other and allowing the spaced apart distance between the axes to vary in response to variations in engine load;

drive means connecting the input shaft with the crankshaft, said drive means including a drive belt and tensioning means for maintaining a relatively constant tension on said belt as said spaced apart distance varies;

means for sensing the cooling requirements of the engine; and means drivingly interposed between the crankshaft and the fan for varying the rotational speed of the fan with respect to the rotational speed of the crankshaft in response to the sensed cooling requirements of the engine.

8. In a vehicle of the type including an engine having a crankshaft mounted therein for rotation about an axis and a fan having an input shaft defining an axis about which the fan rotates, the improvement comprising:

means mounting the engine and fan such that the axes are disposed transverse to the longitudinal axis of the vehicle, substantially parallel to each other, and spaced apart with respect to the longitudinal axis, said mounting means allowing the spaced apart distance between the crankshaft and fan axes to vary in response to engine load;

said fan being a cross-flow fan;

drive means connecting the input shaft with the crankshaft, said drive means including a drive belt and tensioning means for maintaining a relatively constant tension on said belt as said spaced apart distance varies; and means drivingly interposed between the crankshaft and the fan for varying the rotational speed of the fan with respect to the rotational speed of the crankshaft in response to the cooling requirements of the engine.

9. The vehicle of claims 7 or 8, wherein said means drivingly interposed is a viscous coupling.

10. The vehicle of claims 7 or 8, wherein said means drivingly interposed is an electromagnetic clutch.

11. In a vehicle of the type including a frame, an engine having a crankshaft mounted therein for rotation about an axis, means mounting the engine on the frame such that the crankshaft rocks transverse to the crankshaft axis in response to varying engine load, and an engine cooling fan having an input shaft defining an axis about which the fan rotates, the improvement comprising:

means mounting the fan with the fan axis laterally spaced from and substantially parallel to the crankshaft axis and fixed against movement relative to the frame, whereby the spaced apart distance between the fan and crankshaft axes varies in response to varying engine load;

drive means connecting the input shaft with the crankshaft, said drive means including a drive belt and tensioning means for maintaining a relatively constant tension on said belt as said spaced apart distance varies; and a viscous coupling drivingly interposed between the crankshaft and the fan for varying the rotational speed of the fan with respect to the rotational speed of the crankshaft in response to the cooling requirements of the engine.

* * * * *